US009475276B2

(12) United States Patent
Fleischer et al.

(10) Patent No.: US 9,475,276 B2
(45) Date of Patent: Oct. 25, 2016

(54) CAN DECORATOR MACHINE, INK STATION ASSEMBLY THEREFOR, AND CAN DECORATING METHOD EMPLOYING SAME

(75) Inventors: Karl Fleischer, Denver, CO (US); Anthony Joseph Vella, Aurora, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 1269 days.

(21) Appl. No.: 13/094,965

(22) Filed: Apr. 27, 2011

(65) Prior Publication Data

US 2012/0272846 A1 Nov. 1, 2012

(51) Int. Cl.

| | |
|---|---|
| ***B41F 17/22*** | (2006.01) |
| ***B41F 31/02*** | (2006.01) |
| *B41F 31/00* | (2006.01) |

(52) U.S. Cl.

CPC ..... *B41F 17/22* (2013.01); *B41F 31/025* (2013.01); *B41F 31/004* (2013.01)

(58) Field of Classification Search

CPC ..... B41F 17/22; B41F 31/004; B41F 31/06
USPC ..... 101/36–40.1, 348, 349.1, 350.1, 350.2, 101/350.3, 351.3
IPC ..... B41F 17/14, 17/20, 17/22
See application file for complete search history.

(56) References Cited

U.S. PATENT DOCUMENTS

| | | | |
|---|---|---|---|
| 2,326,850 A | 8/1943 | Gladfelter et al. | |
| 2,753,795 A | 7/1956 | Bruns | |
| 4,223,603 A * | 9/1980 | Faddis et al. | 101/138 |
| 4,432,282 A | 2/1984 | Jurinak | |

(Continued)

FOREIGN PATENT DOCUMENTS

| | | |
|---|---|---|
| DE | 3209740 A1 | 12/1982 |
| EP | 0088129 A1 | 9/1983 |

(Continued)

OTHER PUBLICATIONS

International Search Report and Written Opinion dated Jun. 15, 2012.

(Continued)

*Primary Examiner* — Leslie J Evanisko
(74) *Attorney, Agent, or Firm* — Eckert Seamans Cherin & Mellott, LLC; Grant E. Coffield; John P. Powers

(57) ABSTRACT

An ink station assembly is provided for a can decorator machine. The ink station assembly includes an ink fountain providing a supply of ink, a fountain roll, a distributor roll, a ductor roll cooperable with the fountain roll and the distributor roll, a number of oscillator rolls having longitudinal axis and oscillating back and forth along such axis, a number of transfer rolls cooperating with the oscillator rolls, a printing plate cylinder including a printing plate, and a single form roll cooperating with the printing plate cylinder to apply the ink to the printing plate. The diameter of the single form roll is greater than the diameter of the printing plate cylinder such that the printing plate cylinder makes a complete revolution before the single form roll makes a complete revolution. Accordingly, no portion of the single form roll contacts the printing plate more than once per revolution.

20 Claims, 5 Drawing Sheets

(56) References Cited

U.S. PATENT DOCUMENTS

| | | | | |
|---|---|---|---|---|
| 4,445,433 | A | 5/1984 | Navi | |
| 4,721,266 | A | 1/1988 | Haapanen et al. | |
| 4,741,266 | A * | 5/1988 | Stirbis et al. | 101/40 |
| 4,921,093 | A | 5/1990 | Peters et al. | |
| 5,005,476 | A | 4/1991 | Kobler et al. | |
| 5,111,742 | A | 5/1992 | DiDonato et al. | |
| 5,148,742 | A | 9/1992 | Stirbis et al. | |
| 5,183,145 | A | 2/1993 | Williams et al. | |
| 5,231,926 | A | 8/1993 | Williams et al. | |
| 5,233,922 | A | 8/1993 | Stirbis et al. | |
| 5,337,659 | A | 8/1994 | Whelan | |
| 5,363,763 | A | 11/1994 | Fiore | |
| 5,372,067 | A * | 12/1994 | Doyle | 101/148 |
| 5,553,541 | A | 9/1996 | Vrotacoe et al. | |
| 5,572,927 | A | 11/1996 | Sirvet | |
| 5,609,100 | A | 3/1997 | Williams | |
| 5,799,574 | A | 9/1998 | Williams et al. | |
| 5,908,505 | A | 6/1999 | Bargenquest et al. | |
| 6,167,805 | B1 | 1/2001 | Williams et al. | |
| 6,178,886 | B1 | 1/2001 | Williams et al. | |
| 6,467,609 | B1 | 10/2002 | Williams et al. | |
| 6,651,552 | B1 | 11/2003 | Didonato | |
| 6,672,211 | B2 * | 1/2004 | Price et al. | 101/483 |
| 8,069,785 | B2 | 12/2011 | Schafer et al. | |
| 2002/0096066 | A1 | 7/2002 | Callahan et al. | |
| 2005/0045053 | A1 * | 3/2005 | Finan | 101/38.1 |
| 2013/0174753 | A1 * | 7/2013 | Jeter | 101/350.3 |

FOREIGN PATENT DOCUMENTS

| | | | |
|---|---|---|---|
| EP | 0263422 | A2 | 4/1988 |
| EP | 0583667 | A1 | 2/1994 |
| EP | 1262321 | A2 | 12/2002 |
| JP | 08-238756 | | 9/1996 |
| WO | 2008099330 | A2 | 8/2008 |

OTHER PUBLICATIONS

European Patent Office, Supplementary European Search Report for International Application No. PCT/US2012/028391, mailed Oct. 10, 2014.

Japanese Patent Office, "Notification of the First Office Action (English language translation)," 3 pgs., Nov. 17, 2015.

* cited by examiner

CAN DECORATOR MACHINE, INK STATION ASSEMBLY THEREFOR, AND CAN DECORATING METHOD EMPLOYING SAME

BACKGROUND

1. Field

The disclosed concept relates generally to machinery and, more particularly, to can decorator machines and methods for decorating cans used in the food and beverage packaging industries. The disclosed concept also relates to ink station assemblies for can decorator machines.

2. Background Information

High speed continuous motion machines for decorating cans, commonly referred to as can decorator machines or simply can decorators, are generally well known.

FIG. 1 shows a can decorator 2 of the type disclosed, for example, in commonly assigned U.S. Pat. No. 5,337,659, which is incorporated herein by reference. The can decorator 2 includes an infeed conveyor 15, which receives cans 16 from a can supply (not shown) and directs them to arcuate cradles or pockets 17 along the periphery of spaced parallel rings secured to a pocket wheel 12. The pocket wheel 12 is fixedly secured to a continuously rotating mandrel carrier wheel 18, which in turn is keyed to a continuously rotating horizontal drive shaft 19. Horizontal spindles or mandrels (not shown), each being pivotable about its own axis, are mounted to the mandrel carrier wheel 18 adjacent its periphery. Downstream from the infeed conveyor 15, each spindle or mandrel is in closely spaced axial alignment with an individual pocket 17, and undecorated cans 16 are transferred from the pockets 17 to the mandrels by wiping against a stationary arm 42, which is angled inwardly in the downstream direction so as to function as a cam that drives the can 16 toward the corresponding mandrel. Suction applied through an axial passage of the mandrel draws the can 16 to a final seated position on the mandrel.

While mounted on the mandrels, the cans 16 are decorated by being brought into engagement with a blanket (e.g., without limitation, a replaceable adhesive-backed piece of rubber) that is adhered to a blanket segment 21 of the multicolor printing unit indicated generally by reference numeral 22. Thereafter, and while still mounted on the mandrels, the outside of each decorated can 16 is coated with a protective film of varnish applied by engagement with the periphery of an applicating roll (not shown) rotating on a shaft 23 in the overvarnish unit indicated generally by reference numeral 24. Cans 16 with decorations and protective coatings thereon are then transferred from the mandrels to suction cups (not shown) mounted adjacent the periphery of a transfer wheel (not shown) rotating on a shaft 28 of a transfer unit 27. From the transfer unit 27 the cans 16 are deposited on generally horizontal pins 29 carried by a chain-type output conveyor 30, which carries the cans 16 through a curing oven (not shown).

While moving toward engagement with an undecorated can 16, the blanket engages a plurality of printing cylinders 31, each of which is associated with an individual ink station assembly 32 (six ink station assemblies 32 are shown in the example of FIG. 1). Each ink station assembly 32 includes a plurality of form rolls 33, 34 and other rolls (e.g., without limitation, roll 35 shown in simplified form in hidden line drawing in FIG. 1; see also FIG. 5) that produce a controlled film of ink, which is applied to a printing cylinder 31. Typically, each assembly 32 provides a different color ink and each printing cylinder 31 applies a different image segment to the blanket. All of these image segments combine to produce the same main image. This main image is then transferred to undecorated cans 16.

When decorating metal, it is important to supply the printing cylinder 31 with as consistent of an ink film thickness, as possible, in order for the printing plate to impart a clear and consistent image to the printing blanket 21 and ultimately to the final printed substrate (e.g., can 16). Inconsistencies in the ink film can result in variable color density across the printed image, as well as present the possibility of "starvation ghosting" of the image, wherein a lighter duplicate version or copy of the image is undesirably applied to the can 16 in addition to the main image. Prior proposals for solving the problem of ink film consistency and related issues such as starvation ghosting, have included such approaches as adding more form rolls, changing form roll diameters, each of the form rolls having a different diameter all of which are less than the diameter of the printing cylinder, adding a number of rider rolls and/or oscillating rider rolls on one or more of the form rolls, and/or variation of the axial cycle rates of the oscillating roll(s).

There is, therefore, room for improvement in can decorating machines and methods, and in ink station assemblies.

SUMMARY

These needs and others are met by embodiments of the disclosed concept, which are directed to an ink station assembly for a can decorator machine and an associated method of decorating cans. Among other benefits, the ink station assembly and method employ a single form roll to address ink inconsistencies and issues (e.g., without limitation, ink starvation; ink film thickness; variation of ink film thickness; image ghosting).

As one aspect of the disclosed concept, an ink station assembly is provided for a can decorator machine structured to decorate a plurality of cans. The ink station assembly comprises: an ink fountain structured to provide a supply of ink; a fountain roll structured to receive the ink from the ink fountain; a distributor roll; a ductor roll being cooperable with the fountain roll and the distributor roll to transfer the ink from the fountain roll to the distributor roll; a number of oscillator rolls each having a longitudinal axis and being structured to oscillate back and forth along the longitudinal axis; a number of transfer rolls each cooperating with at least one of the oscillator rolls; a printing plate cylinder including a printing plate; and a single form roll cooperating with the printing plate cylinder to apply the ink to the printing plate.

The single form roll may have a first diameter, and the printing plate cylinder may have a second diameter, wherein the first diameter of the single form roll is greater than the second diameter of the printing plate cylinder. The printing plate cylinder may make a complete revolution before the single form roll makes a complete revolution, in order that no portion of the single form roll contacts the printing plate more than once per revolution.

The ink station assembly may further comprise a first side plate, a second side plate disposed opposite and distal from the first side plate, a drive assembly, and a housing at least partially enclosing the drive assembly. The first side plate may have a first side and a second side. The fountain roll, the distributor roll, the ductor roll, the oscillator rolls, the transfer rolls, and the single form roll may be pivotably disposed on the first side of the first plate between the first side plate and the second side plate. The drive assembly may be disposed on the second side of the first side plate, may drive at least the fountain roll, the distributor roll, and the oscillator rolls, and may oscillate the oscillator rolls.

A can decorator machine and method of decorating cans are also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
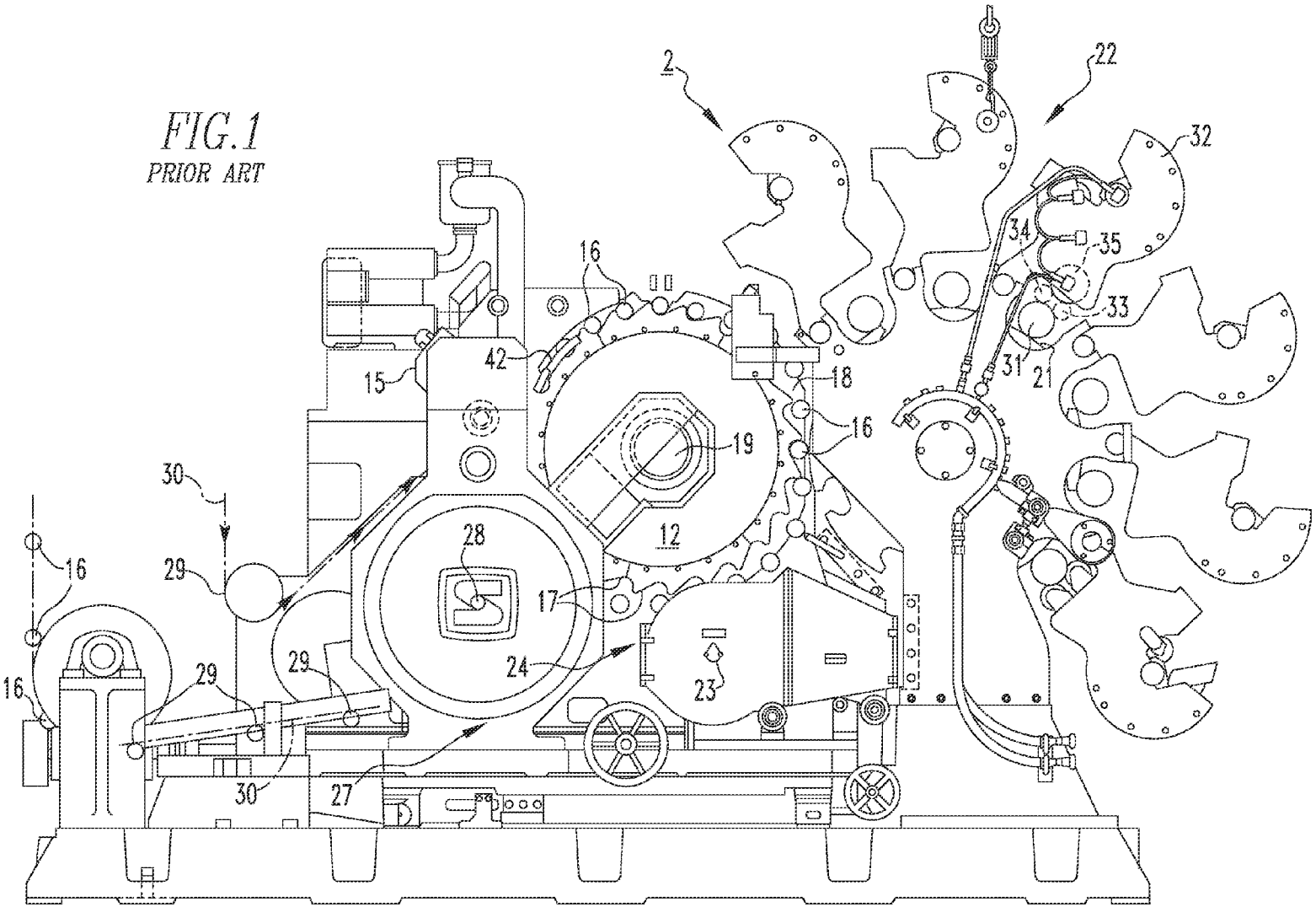
FIG. 1 PRIOR ART
FIG. 1 is a side elevation view of a can decorator machine.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the term "can" refers to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "ink train" refers to the pathway by which ink is transferred through the ink station assembly and, in particular, from the ink fountain, through the various rolls of the ink station assembly to the printing plate cylinder.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
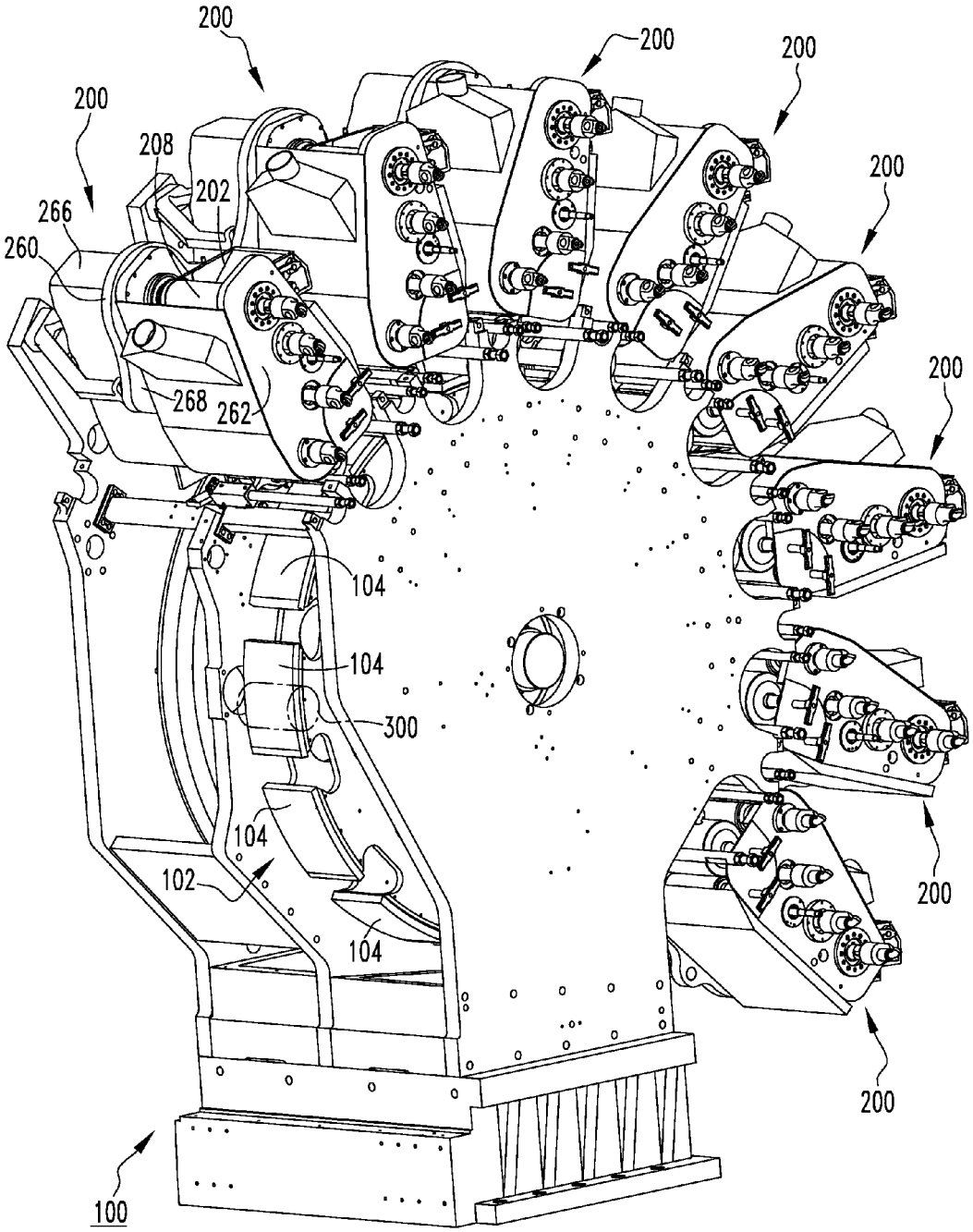
FIG. 2 is an isometric view of a portion of a can decorator machine and ink station assembly therefor, in accordance with an embodiment of the disclosed concept.

FIG. 2 shows a portion of a can decorator machine 100 including a plurality of ink station assemblies 200 (eight are shown) in accordance with the disclosed concept. The can decorator machine 100 is structured to decorate (e.g., apply a desired ink-based image to the exterior of) a plurality of cans 300 (one can 300 is shown in simplified form in phantom line drawing in FIG. 2 for simplicity of illustration). Among other components, the can decorator machine 100, also sometimes referred to simply as a can decorator, includes a blanket 102 and a plurality of image transfer segments 104 (also shown in phantom line drawing in FIG. 4). Preferably, the blanket 102 is structured to transfer an image associated with each image transfer segment 104 to a corresponding one of the cans 300. As previously noted, the can decorator 100 further includes a plurality of ink station assemblies 200. It will be appreciated that, while the can decorator 100 in the example shown and described herein includes eight ink station assemblies 200, that it could alternatively contain any known or suitable alternative number and/or configuration of ink station assemblies (not shown), without departing from the scope of the disclosed concept. It will further be appreciated that, for economy of disclosure and simplicity of illustration, only one of the ink station assemblies 200 will be shown and described in detail herein.

Figure 3:
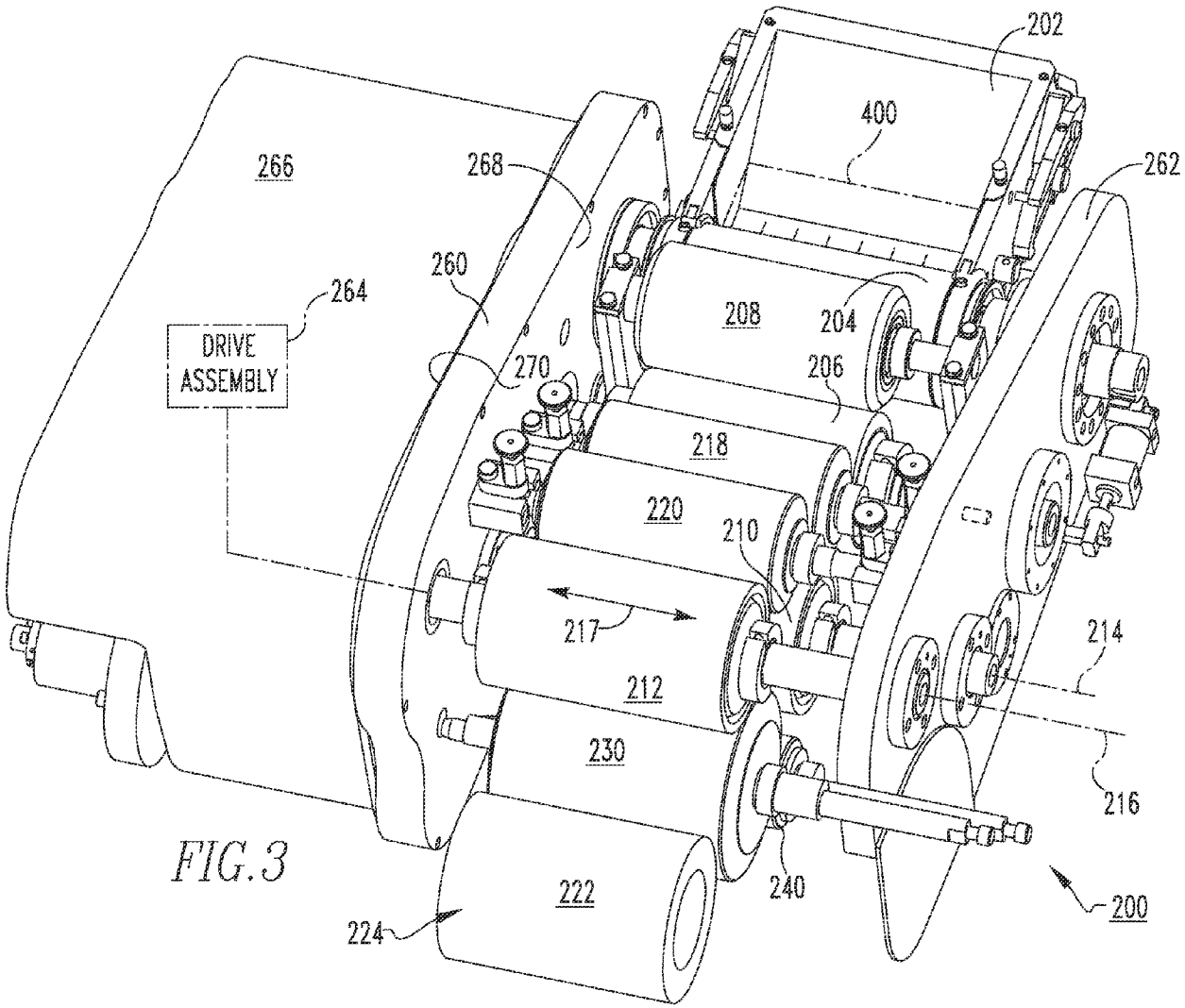
FIG. 3 is an isometric view of one of the ink station assemblies of FIG. 2.
Figure 4:
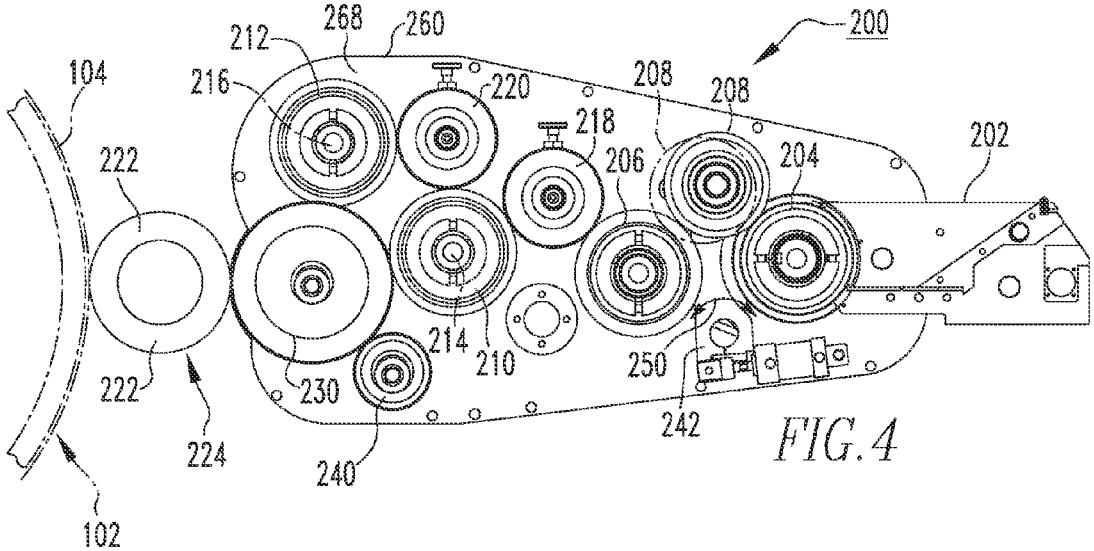
FIG. 4 is a side elevation view of the ink station assembly of FIG. 3 with one of the side plates removed to show hidden structures.

FIGS. 3 and 4 show one non-limiting example embodiment of the ink station assembly 200 in greater detail. Specifically, the ink station assembly 200 includes an ink fountain 202 structured to provide a supply of ink 400 (shown in phantom line drawing in simplified form in FIG. 3; see also FIG. 6). A fountain roll 204 receives the ink 400 from the ink fountain 202. The ink station assembly 200 further includes a distributor roll 206 and a ductor roll 208 that is cooperable with both the fountain roll 204 and the distributor roll 206 to transfer the ink 400 from the fountain roll 204 to the distributor roll 206. A number of oscillator rolls 210,212 (two are shown) each include a longitudinal axis 214,216, respectively. The oscillator rolls 210,212 are structured to oscillate back and forth along such longitudinal axis 214,216, respectively. By way of example, and without limitation, it will be appreciated that oscillator roll 212 in the example of FIG. 3 oscillates back and forth along axis 216 in the directions generally indicated by arrow 217. Oscillator roll 210 (partially shown in FIG. 3; see also FIGS. 4 and 6) oscillates back and forth along longitudinal axis 214 in a similar manner. It will further be appreciated that, although the example shown and described herein includes two oscillator rolls 210,212, that any known or suitable alternative number and/or configuration of oscillator rolls (not shown) could be employed in accordance with the disclosed concept. The example ink station assembly 200 also includes two transfer rolls 218,220, each of which cooperates with at least one of the oscillator rolls 210,212. It will be appreciated, however, that any known or suitable alternative number and/or configuration of transfer rolls (not shown) other than that which is shown and described herein, could be employed without departing from the scope of the disclosed concept.

Figure 5:
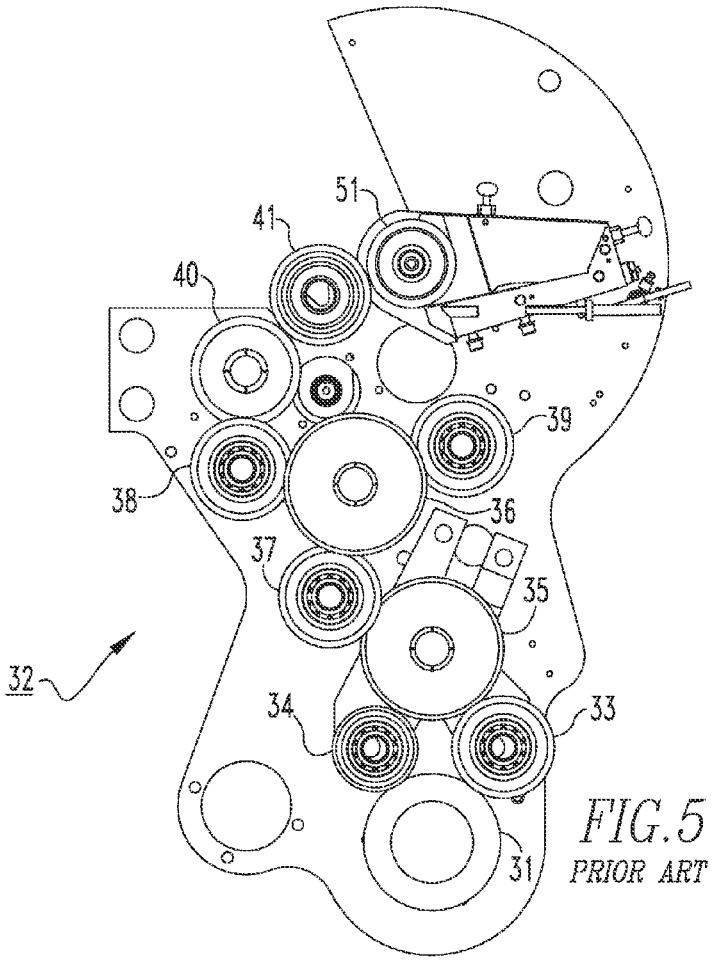
FIG. 5 PRIOR ART
FIG. 5 is a side elevation view of one of the ink station assemblies of FIG. 1, with one of the side plates removed to show hidden structures.

A printing plate cylinder 222 includes a printing plate (generally indicated by reference number 224), and cooperates with a single form roll 230 to apply the ink 400 to the printing plate 224, as will be described in greater detail hereinbelow. Accordingly, it will be appreciated that the roll configuration of the disclosed ink station assembly 200 is improved compared to prior art ink station assemblies (see, for example, ink station assembly 32 of FIGS. 1 and 5). More specifically, among other benefits, the exemplary ink station assembly 200 includes a total of nine rolls (e.g., fountain roll 204, distributor roll 206, ductor roll 208, first and second oscillator rolls 210,212, first and second transfer rolls 218,220, single form roll 230, and rider roll 240). This is one less roll than the prior an ink station assembly 32, which as shown in FIG. 5 includes at least 10 rolls (e.g., first and second form rolls 33,34, first and second, oscillator rolls 35,36, first, second, third, and fourth transfer rolls 37,38,39, 40, ductor roll 41 and fountain roll 51). Furthermore, prior art ink station assembly 32 includes two form rolls 33,34, both of which have a smaller diameter than the diameter of the printing plate cylinder 31, as shown in FIG. 5. Among other disadvantages, this can result in ink inconsistencies such as, for example and without limitation, "starvation ghosting" of the desired image.

Figure 6:
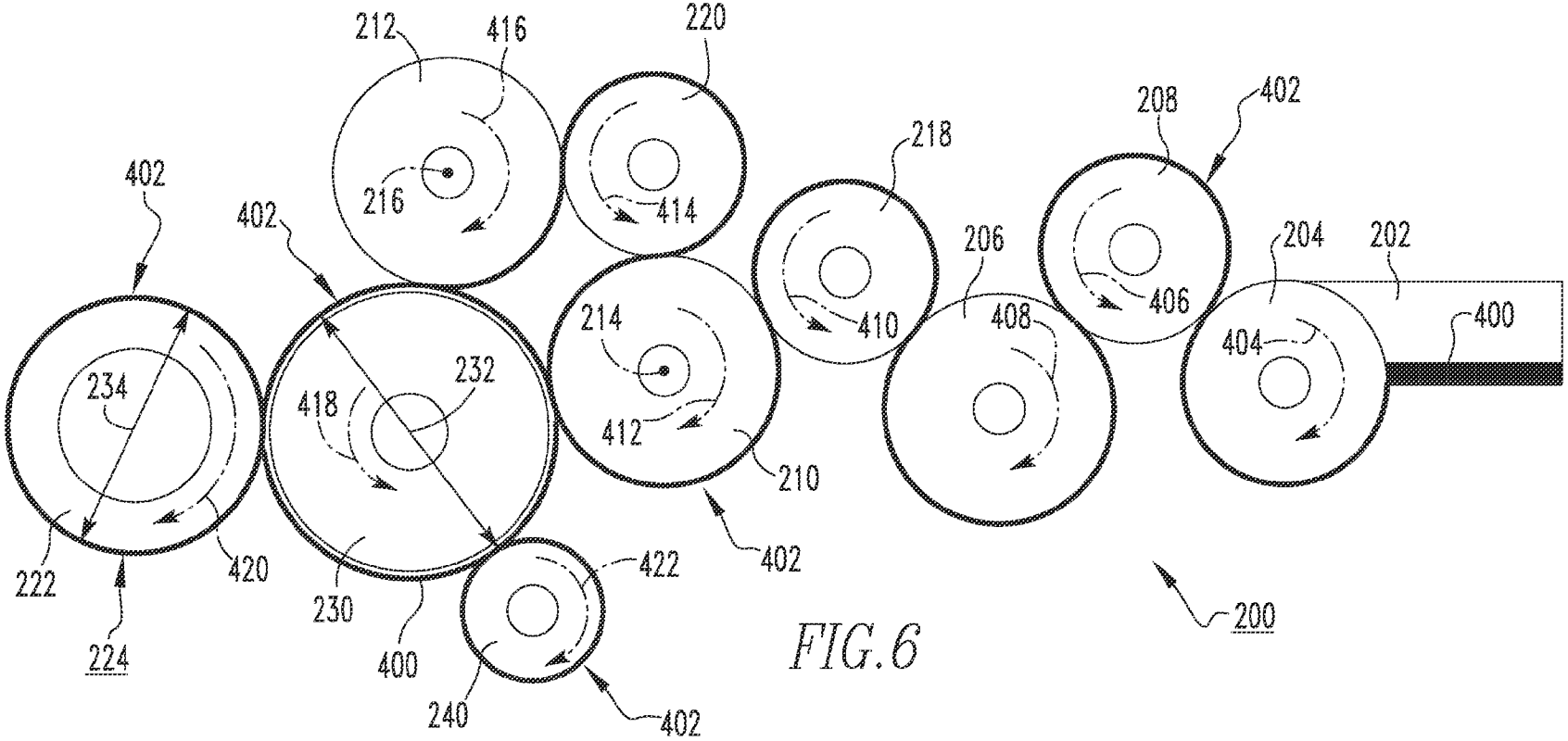
FIG. 6 is a simplified view of the ink station assembly of FIG. 4, showing the ink train in accordance with an embodiment of the disclosed concept.

As shown in FIG. 6, the disclosed ink station assembly 200 includes only one single form roll 230, which has a first diameter 232, and the printing plate cylinder 222 has a second diameter 234. The first diameter 232 of the single form roll 230 is greater than the second diameter 234 of the printing plate cylinder 222. Accordingly, the disclosed ink station assembly 200 and, in particular, the single form roll 230 thereof, addresses and overcomes the aforementioned ink inconsistencies and associated problems (e.g., without limitation, "starvation ghosting") by virtue of the fact that the printing plate cylinder 222 will make a complete revolution (e.g., rotate clockwise in the direction of arrow 420 of FIG. 6 one complete revolution) before the single form roll 230 makes a complete revolution (e.g., rotate counterclockwise in the direction of arrow 418 of FIG. 6 one complete revolution). In other words, no portion of the single form roll 230 will contact the printing plate 224 of the printing plate cylinder 222 more than once, per revolution.

In accordance with one non-limiting embodiment, the first diameter 232 of the single form roll 230 is greater than 5 inches. It will, however, be appreciated that the single form roll 230 could have any known or suitable alternative diameter that is preferably larger than the diameter 234 of the printing plate cylinder 222.

Continuing to refer to FIG. 6, as well as FIGS. 3 and 4, the example ink station assembly 200 further includes first and second transfer rolls 218,220. The first transfer roll 218 cooperates with the distributor roll 206 and the first oscillator roll 210. The second transfer roll 220 cooperates with the first oscillator roll 210 and the second oscillator roll 212. The first oscillator 210 and the second oscillator roll 212, in the example shown and described herein, both cooperate with the single form roll 230.

As best shown in FIGS. 4 and 6, the ink station assembly 200 preferably further includes a rider roll 240, which cooperates with a single form roll 230 to smooth and redistribute any remaining ink 400 to areas where the ink 400 may have been removed by the printing plate 224 during a prior revolution of a single form roll 230 and printing plate cylinder 222. Accordingly, the rider roll 240 helps to further address and overcome ink inconsistencies, depletion and/or starvation issues known to exist in the prior art.

In operation, the ink 400 forms an ink train 402 as it is transferred from the ink fountain 202 to the printing plate cylinder 222. As shown in FIG. 6, the ink train 402 is defined by the fountain roll 204 revolving clockwise in the direction indicated by arrow 404, the ductor roll 208 revolving counterclockwise in the direction of arrow 406, the distributor roll 206 revolving clockwise in the direction of arrow 408, the first transfer roll 218 revolving counterclockwise in the direction of arrow 410, the first oscillator roll 210 revolving clockwise in the direction of arrow 412, the second transfer roll 220 revolving counterclockwise in the direction of arrow 414, the second oscillator roll 212 revolving clockwise in the direction of arrow 416, the single form roll 230 revolving counterclockwise in the direction of arrow 418, the printing plate cylinder 222 revolving clockwise in the direction of arrow 420, and the rider roll 240 revolving clockwise in the direction of arrow 422. It will be appreciated that while the flow of ink 400 in the ink train 402 is illustrated in FIG. 6 by the relatively thick, dark line surrounding the aforementioned rolls to show the transfer pathway of the ink from the ink fountain 200 to the printing plate cylinder 222, this is provided as a simplified visual aid for purposes of illustration. That is, it will be appreciated that in operation, when the machine 100 is running, the ink train 402 reaches equilibrium with a progressively thinner ink film following each roll pair contact (commonly referred to as a nip), with the thinnest film ending up on the plate 224. This is because the ink essentially splits in half at each nip. It will also be appreciated that each of the rolls may be independently driven (e.g., revolved) by the drive assembly 264 (FIG. 3) (e.g., without limitation, a gear assembly), or by engagement and interaction with one or more adjacent rolls. For example and without limitation, in accordance with one non-limiting embodiment of the disclosed concept, the ductor roll 208, transfer rolls 218,220 and form roll 230 are driven (e.g., revolved; rotated) by engagement and interaction with an adjacent roll, whereas all other rolls in the ink station assembly 200 are gear driven by the drive assembly 264 (FIG. 3).

Referring again to FIG. 3, the ink station assembly 200 further includes first and second opposing side plates 260, 262, a drive assembly 264 (shown in simplified form in hidden line drawing), and a housing 266 at least partially enclosing the drive assembly 264. The first side plate 260 has first and second opposing sides 268,270. The fountain roll 204, the distributor roll 206, the ductor roll 208, the oscillator rolls 210,212, the transfer rolls 218,220, and the single form roll 230 are all preferably pivotably disposed on the first side 268 of the first side plate 260, between the first and second side plates 260,262, as shown. The drive assembly 264 is disposed on the second side 270 of the first side plate 260, and is structured to drive at least the fountain roll 204, distributor roll 206, and oscillator rolls 210,212, in a generally well known manner. The drive assembly 264 also oscillates the oscillator rolls 210,212 on axis 214,216, respectively, as previously described hereinabove.

Accordingly, the method of decorating cans using the can decorator 100 (partially shown in FIG. 2) in accordance with the disclosed concept includes the steps of: (a) providing a number of the aforementioned ink station assemblies 200, (b) operating the drive assembly 264 (FIG. 3) to move at least one of the fountain roll 204, the distributor roll 206, and the oscillator rolls 210,212 to transfer the ink 400 from the ink fountain 202 to the single form roll 230, (c) coating the printing plate 224 of the printing plate cylinder 222 with ink 400 from the single form roll 230, (d) rotating the blanket 102 (FIG. 2; also partially shown in phantom line drawing in FIG. 4) to bring the printing plate 224 into contact with the blanket 102 at or about a corresponding one of the image transfer segments 104 (FIG. 2; also shown in phantom line drawing in FIG. 4), (e) creating an image on the blanket 102, (f) engaging the image blanket 102 with a corresponding one of the cans 300 (shown in simplified form in phantom line drawing in FIG. 2), and (g) transferring the desired image to the can 300 (FIG. 2).

Referring again to FIG. 4, it will be appreciated that the ductor roll 208 of the example ink station assembly 200 is preferably pivotably coupled to the first side 268 of the first side plate 260 by a suitable pivot member 242. Specifically, the ductor roll 208 is pivotable (e.g., clockwise and counterclockwise, by way of pivot member 242, in the direction of arrow 250 from the perspective of FIG. 4) between a first position (shown in solid line drawing in FIG. 4) corresponding to the ductor roll 208 cooperating with the fountain roll 204, and a second position (shown in phantom line drawing in FIG. 4) corresponding to the ductor roll 208 cooperating with the distributor roll 206.

The improved ink consistency (e.g., without limitation, sufficient ink volume; consistent ink film thickness; absence of "starvation ghosting") and associated improved image quality afforded by the disclosed ink station assembly 200 will be further appreciated by reference to the following EXAMPLE, which is provided solely for purposes of illustration and is not intended to limit the scope of the disclosed concept in anyway.

EXAMPLE

In the following EXAMPLE, an analysis of the new ink train 402 (FIG. 6) provided by the disclosed ink station assembly 200 was evaluated and compared to the ink transfer occurring in existing Rutherford® and Concord® ink station assemblies. Rutherford® and Concord® are registered trademarks of the Stolle Machinery Company LLC, which has a place of business at 6949 South Potomac Street, Centennial, Colo., and which sells Rutherford® and Concord® can decorators.

Specifically, for the test, the printing surface (e.g., exterior surface of can 300 (FIG. 2)) was divided into segments 0.100 inches wide along the entire length of the printed area. The ink film thickness and the variation of that thickness between two adjoining segments as well as the maximum variation that occurs around the entire printed area, were calculated and evaluated. The analysis was performed for a 20 can run. Tables 1 and 2, below, clearly illustrate the improvement in maximum film variation around the entire can 300 and film variation between adjacent segments, respectively, that the exemplary ink station assembly 200 and associated ink train 402 (FIG. 6) afford.

TABLE 1

| Max Film Variation Around Entire Can | | |
|---|---|---|
| | Lowest % within 20 cans | Highest % within 20 cans |
| Rutherford | 6.8% | 12.9% |
| Concord | 8.8% | 14.7% |
| New Gen | 4.2% | 7.5% |

TABLE 2

| Film Variation Between Adjacent Segments | | |
|---|---|---|
| | Lowest % within 20 cans | Highest % within 20 cans |
| Rutherford | 5.1% | 6.3% |
| Concord | 4.4% | 7.8% |
| New Gen | 2.9% | 3.4% |

Accordingly, it will be appreciated that the disclosed concept provides a can decorator 100, ink station assembly 200, and associated method of decorating cans 300 (FIG. 2), which improve the quality and consistency of the ink transfer, and thus the overall image quality, on cans 300 being decorated thereby. Additionally, the ink station assembly 200 includes an improved roll configuration, which effectively transfers ink 400 from the ink fountain 202, addresses ink deprivation and inconsistency issues (e.g., without limitation, "starvation ghosting"), and is relatively easier to service (e.g., repair; maintain) and retrofit to existing can decorators than prior art designs. Among other reasons for this, is the fact that the ink station assembly 200 efficiently and effectively transfers ink 400 using a minimal number of rolls and an enhanced configuration.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An ink station assembly for a can decorator machine structured to decorate a plurality of cans, the ink station assembly comprising:

an ink fountain structured to provide a supply of ink;

a fountain roll structured to receive said ink from the ink fountain;

a distributor roll;

a ductor roll being cooperable with the fountain roll and the distributor roll to transfer said ink from the fountain roll to the distributor roll;

a number of oscillator rolls each having a longitudinal axis and being structured to oscillate back and forth along said longitudinal axis;

a number of transfer rolls each cooperating with at least one of the oscillator rolls;

a printing plate cylinder including a printing plate; and a single form roll cooperating with the printing plate cylinder to apply said ink to the printing plate, wherein the total number of rolls within said ink station assembly is less than ten.

2. The ink station assembly of claim 1 wherein the single form roll has a first diameter; wherein the printing plate cylinder has a second diameter; and wherein the first diameter of the single form roll is greater than the second diameter of the printing plate cylinder.

3. The ink station assembly of claim 2 wherein the printing plate cylinder makes a complete revolution before the single form roll makes a complete revolution, in order that no portion of the single form roll contacts the printing plate more than once per revolution.

4. The ink station assembly of claim 2 wherein the first diameter of the single form roll is greater than 5 inches.

5. The ink station assembly of claim 1 wherein the number of oscillator rolls is a first oscillator roll and a second oscillator roll; wherein the number of transfer rolls is a first transfer roll and a second transfer roll; wherein the first transfer roll cooperates with the distributor roll and the first oscillator roll; and wherein the second transfer roll cooperates with the first oscillator roll and the second oscillator roll.

6. The ink station assembly of claim 5 wherein the first oscillator roll and the second oscillator roll cooperate with the single form roll.

7. The ink station assembly of claim 5 further comprising a rider roll; and wherein the rider roll cooperates with the single form roll to smooth and redistribute remaining ink to areas where ink was removed by the printing plate.

8. The ink station assembly of claim 7 wherein said ink forms an ink train as it is transferred from the ink fountain to the printing plate cylinder; and wherein said ink train is defined by the fountain roll revolving clockwise, the ductor roll revolving counterclockwise, the distributor roll revolving clockwise, the first transfer roll revolving counterclockwise, the first oscillator roll revolving clockwise, the second transfer roll revolving counterclockwise, the second oscillator roll revolving clockwise, the single form roll revolving counterclockwise, the printing plate cylinder revolving clockwise, and the rider roll revolving clockwise.

9. The ink station assembly of claim 1 wherein the ductor roll is pivotable between a first position corresponding to the doctor roll cooperating with the fountain roll, and a second position corresponding to the ductor roll cooperating with the distributor roll.

10. The ink station assembly of claim 1 further comprising a first side plate, a second side plate disposed opposite and distal from the first side plate, a drive assembly, and a housing at least partially enclosing the drive assembly; wherein the first side plate has a first side and a second side; wherein the fountain roll, the distributor roll, the ductor roll, the oscillator rolls, the transfer rolls, and the single form roll are pivotably disposed on the first side of the first side plate between the first side plate and the second side plate; wherein the drive assembly is disposed on the second side of the first side plate; wherein the drive assembly drives at least the fountain roll, the distributor roll, and the oscillator rolls; and wherein the drive assembly oscillates the oscillator rolls.

11. A can decorator machine for decorating cans, the can decorator machine comprising:

a blanket wheel including a plurality of image transfer segments and a blanket disposed on the image transfer segments, the blanket being structured to transfer an image to a corresponding one of the cans; and a plurality of ink station assemblies, each of said ink station assemblies comprising:

an ink fountain providing a supply of ink, a fountain roll receiving said ink from the ink fountain, a distributor roll, a ductor roll being cooperable with the fountain roll and the distributor roll to transfer said ink from the fountain roll to the distributor roll, a number of oscillator rolls each having a longitudinal axis and being structured to oscillate back and forth along said longitudinal axis, a number of transfer rolls each cooperating with at least one of the oscillator rolls, a printing plate cylinder including a printing plate, the printing plate being cooperable with a corresponding one of the image transfer segments of the blanket, and a single form roll cooperating with the printing plate cylinder to apply said ink to the printing plate, wherein the total number of rolls within said ink station assembly is less than ten.

12. The can decorator machine of claim 11 wherein the single form roll has a first diameter; wherein the printing plate cylinder has a second diameter; and wherein the first diameter of the single form roll is greater than the second diameter of the printing plate cylinder.

13. The can decorator machine of claim 11 wherein the number of oscillator rolls is a first oscillator roll and a second oscillator roll; wherein the number of transfer rolls is a first transfer roll and a second transfer roll; wherein the first transfer roll cooperates with the distributor roll and the first oscillator roll; wherein the second transfer roll cooperates with the first oscillator roll and the second oscillator roll; and wherein the first oscillator roll and the second oscillator roll cooperate with the single form roll.

14. The can decorator machine of claim 13 further comprising a rider roll; and wherein the rider roll cooperates with the single form roll to smooth and redistribute remaining ink to areas where ink was removed by the printing plate.

15. The can decorator machine of claim 14 wherein said ink forms an ink train as it is transferred from the ink fountain to the printing plate cylinder; and wherein said ink train is defined by the fountain roll revolving clockwise, the ductor roll revolving counterclockwise, the distributor roll revolving clockwise, the first transfer roll revolving counterclockwise, the first oscillator roll revolving clockwise, the second transfer roll revolving counterclockwise, the second oscillator roll revolving clockwise, the single form roll revolving counterclockwise, the printing plate cylinder revolving clockwise, and the rider roll revolving clockwise.

16. The can decorator machine of claim 11 wherein the plurality of ink station assemblies is eight ink station assemblies; wherein each of the ink station assemblies further comprises a first side plate, a second side plate disposed opposite and distal from the first side plate, a drive assembly, and a housing at least partially enclosing the drive assembly; wherein the first side plate has a first side and a second side; wherein the fountain roll, the distributor roll, the ductor roll, the oscillator rolls, the transfer rolls, and the single form roll are pivotably disposed on the first side of the first plate between the first side plate and the second side plate; wherein the drive assembly is disposed on the second side of the first side plate; wherein the drive assembly drives at least the fountain roll, the distributor roll, and the oscillator rolls; and wherein the drive assembly oscillates the oscillator rolls.

17. A method of decorating cans using a can decorator machine, the can decorator machine comprising a blanket and a plurality of image transfer segments, the method comprising:

(a) providing an ink station assembly, the ink station assembly comprising:

a drive assembly, an ink fountain for supplying ink, a fountain roll for receiving said ink from the ink fountain, a distributor roll, a ductor roll being cooperable with the fountain roll and the distributor roll to transfer said ink from the fountain roll to the distributor roll, a number of oscillator rolls each having a longitudinal axis and being structured to oscillate back and forth along said longitudinal axis, a number of transfer rolls each cooperating with at least one of the oscillator rolls, a printing plate cylinder including a printing plate, and a single form roll cooperating with the printing plate cylinder wherein the total number of rolls within said ink station assembly is less than ten, (b) operating the drive assembly to move at least one of the fountain roll, the distributor roll, and the oscillator rolls to transfer ink from the ink fountain to the single form roll, (c) coating the printing plate of the printing plate cylinder with ink from the single form roll, (d) rotating the blanket to bring the printing plate into contact with the blanket at or about a corresponding one of the image transfer segments, (e) creating an image on the blanket, (f) engaging the blanket with a corresponding one of the cans, and (g) transferring the image to the can.

18. The method of claim 17, further comprising the printing plate cylinder making a complete revolution before the single form roll makes a complete revolution, in order that no portion of the form roll contacts the printing plate more than once per revolution.

19. The method of claim 17, further comprising:

providing the ink station assembly with a first oscillator roll, a second oscillator roll, a first transfer roll, a second transfer roll, and a rider roll, revolving the fountain roll clockwise, revolving the ductor roll counterclockwise, revolving the distributor roll clockwise, revolving the first transfer roll counterclockwise, revolving the first oscillator roll clockwise, revolving the second transfer roll counterclockwise, revolving the second oscillator roll clockwise, revolving the single form roll counterclockwise, revolving the printing plate cylinder clockwise, and revolving the rider roll clockwise.

20. The method of claim 17, further comprising the can decorator machine including eight ink station assemblies.

* * * * *